US010442234B2

(12) United States Patent
Tago et al.

(10) Patent No.: US 10,442,234 B2
(45) Date of Patent: Oct. 15, 2019

(54) BOOKLET FINISHING DEVICE

(71) Applicants: HITACHI METALS, LTD., Tokyo (JP); Hitachi Metals Precision, Ltd., Tokyo (JP)

(72) Inventors: Makoto Tago, Tokyo (JP); Junichi Nakao, Tokyo (JP)

(73) Assignees: HITACHI METALS, LTD., Tokyo (JP); Hitachi Metals Precision, Ltd., Tokyo (JP)

( * ) Notice: Subject to any disclaimer, the term of this patent is extended or adjusted under 35 U.S.C. 154(b) by 0 days.

(21) Appl. No.: 16/046,405

(22) Filed: Jul. 26, 2018

(65) Prior Publication Data

US 2019/0054751 A1 Feb. 21, 2019

(30) Foreign Application Priority Data

Aug. 16, 2017 (JP) ..... 2017-157168

(51) Int. Cl.

| | |
|---|---|
| ***B42C 13/00*** | (2006.01) |
| ***B42C 5/02*** | (2006.01) |
| ***B65H 37/06*** | (2006.01) |
| ***B42C 3/00*** | (2006.01) |

(52) U.S. Cl.

CPC ..... *B42C 13/00* (2013.01); *B42C 3/00* (2013.01); *B42C 5/02* (2013.01); *B65H 37/06* (2013.01)

(58) Field of Classification Search

CPC ..... B42C 13/00; B42C 3/00; B65H 45/12; B65H 37/06

USPC ..... 412/9, 17, 18, 22, 30

See application file for complete search history.

(56) References Cited

U.S. PATENT DOCUMENTS

2007/0098525 A1 5/2007 Awano
2017/0341899 A1* 11/2017 Watkiss ..... B42C 19/02

FOREIGN PATENT DOCUMENTS

JP 2007-118518 A 5/2007

* cited by examiner

*Primary Examiner* — Justin V Lewis
(74) *Attorney, Agent, or Firm* — Studebaker & Brackett PC

(57) ABSTRACT

Provided is a booklet finishing device including: a frame; a first pressing unit and a second pressing unit which are configured to move relative to each other in a thickness direction of the booklet and configured to press the front surface and back surface of the booklet respectively; a forming roller configured to press the spine portion; and a forming roller moving unit for moving the forming roller along the spine portion. The first pressing unit includes: a first movable component; and a first guide component having a plate-shape. A surface of the first guide component facing the second pressing unit includes: a first guide surface; a first contact surface; and a first corner-forming end portion.

4 Claims, 5 Drawing Sheets

BOOKLET FINISHING DEVICE

BACKGROUND

Technical Field

The present invention relates to a booklet finishing device.

Related Art

A booklet finishing device is known from JP-A-2007-118518 or the like. In the booklet finishing device, a vicinity of a portion which is to become a spine portion of a booklet is clamped by a pair of clamping jaws movable in a thickness direction of the booklet, and the portion which is to become the spine portion of the booklet is pressed with a forming roller in a direction perpendicular to the thickness direction of the booklet toward a fore edge portion side of the booklet, so that the spine portion of the booklet is formed flat.

SUMMARY OF THE INVENTION

In the booklet finishing device described in JP-A-2007-118518, the booklet cannot be successfully conveyed to a space between the pair of clamping jaws, which causes operation failure. Further, although it is required to finish corner portions of the spine portion of the booklet into exact angular shapes, it is difficult to acquire a satisfactory quality using the booklet finishing device of JP-A-2007-118518.

Accordingly, an object of the present invention is to provide a booklet finishing device capable of favorably conveying a booklet and forming good corner portions on the spine portion of the booklet.

A booklet finishing device according to one aspect of the present invention is a booklet finishing device for flattening a spine portion of a booklet formed by folding a plurality of sheet materials. The booklet finishing device includes: a frame; a first pressing unit and a second pressing unit which are configured to move relative to each other in a thickness direction of the booklet and configured to press a front surface and a back surface of the booklet respectively; a forming roller configured to press the spine portion in a direction perpendicular to the thickness direction; and a forming roller moving unit that moves the forming roller along the spine portion of the booklet. The first pressing unit includes: a first movable component supported by the frame and configured to move relative to the second pressing unit in the thickness direction; and a first guide component having a plate-shape and attached to a surface of the first movable component, the surface facing the second pressing unit. A surface of the first guide component facing the second pressing unit includes: a first guide surface inclined to an insertion side of the booklet in a manner that the interval between the first guide surface and the second pressing unit is widened toward the insertion side of the booklet; a first contact surface extending along the moving direction of the forming roller and configured to contact the front surface of the booklet; and a first corner-forming end portion configured to form a corner portion of the spine portion of the booklet with the forming roller, the first corner-forming end portion being opposite to the insertion side of the booklet.

In the booklet finishing device described above, the second pressing unit may also include: a second movable component supported by the frame and configured to move relative to the first pressing unit in the thickness direction of the booklet; and a second guide component having a plate-shape and attached to a surface of the second movable component facing the first pressing unit. A surface of the second guide component facing the first pressing unit includes: a second guide surface inclined to the insertion side of the booklet in a manner that the interval between the second guide surface and the first pressing unit is widened toward the insertion side of the booklet; a second contact surface extending along the moving direction of the forming roller and configured to contact the back surface of the booklet; and a second corner-forming end portion configured to form a corner portion of the spine portion of the booklet with the forming roller, the second corner-forming end portion being opposite to the insertion side of the booklet.

The booklet finishing device described above may also include an aligning mechanism that moves the center in the width direction of the roller surface of the forming roller to the center in the thickness direction of the thickness of the booklet according to the clearance distance between the first contact surface and the second contact surface when the first pressing unit and the second pressing unit press the booklet.

In the booklet finishing device described above, the second pressing unit is fixed to the frame; the aligning mechanism includes: a first shaft provided on the first pressing unit; a second shaft provided on the forming roller; a third shaft provided on the second pressing unit or the frame; and a lever component. The lever component has: a first hole portion through which the first shaft passes; a second hole portion through which the second shaft passes; and a third hole portion through which the third shaft passes; and the lever mechanism may be configured in which the first shaft serves as a force point, the second shaft serves as a point of application, and the third shaft serves as a fulcrum.

In the booklet finishing device described above, the roller surface of the forming roller may be barrel-shaped with the center portion protruding in the width direction.

Effect of the Invention

According to the present invention, a booklet finishing device is provided, which can easily convey and position the booklet between the first pressing unit and the second pressing unit, and can form the corner portions favorably on the spine portion of the booklet.

BRIEF DESCRIPTION OF DRAWINGS

Exemplary embodiment(s) of the present invention will be described in detail based on the following figures, wherein.

DETAILED DESCRIPTION

A booklet finishing device according to an embodiment of the present invention will be described below with reference to the drawings. It should be noted that the present invention is not limited to the illustrative examples, but is indicated by the scope of the claims, and it is intended that all modifications within meaning and scope equivalent to the claims are included.

Figure 1:
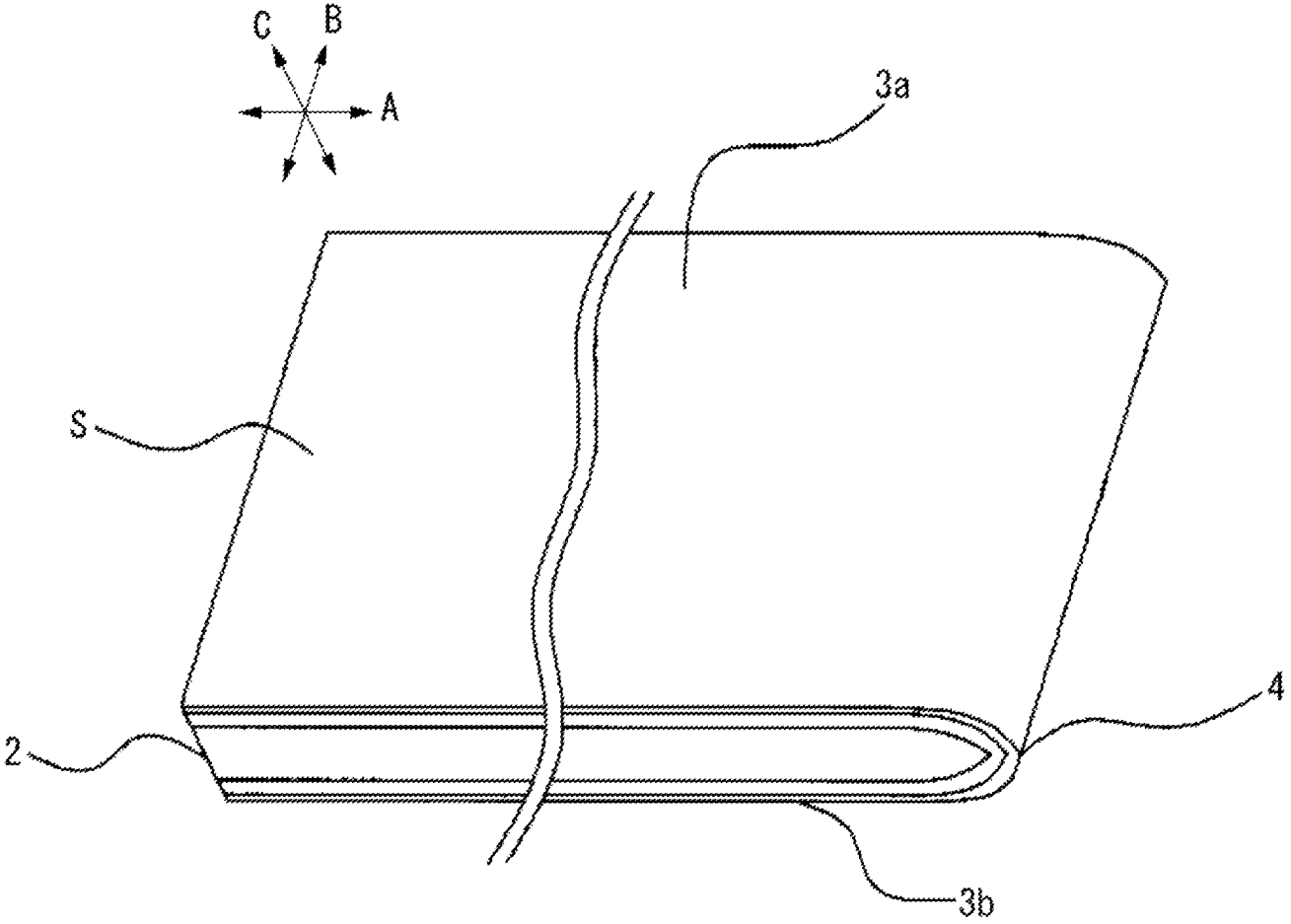
FIG. 1 shows a booklet before finishing with a booklet finishing device.
Figure 2:
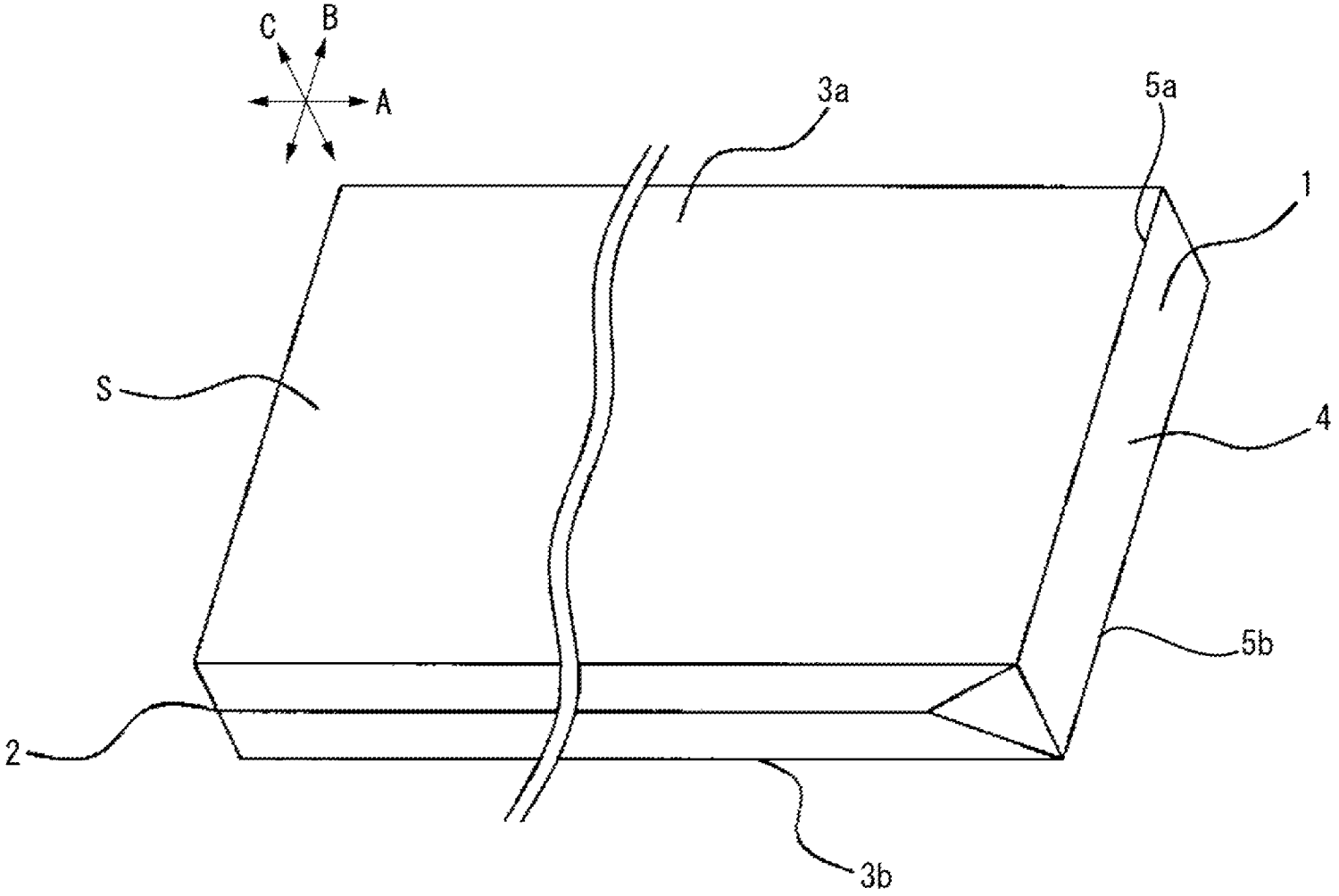
FIG. 2 shows a booklet after finishing with the booklet finishing device.

First, a booklet to be finished by the booklet finishing device according to the present embodiment will be described. FIG. 1 shows a booklet S before finishing, and FIG. 2 shows a booklet S after finishing. The booklet S shown in FIG. 1 and FIG. 2 is formed by folding a plurality of sheet materials into two parts.

In the following description, reference numeral 4 denotes a spine portion, reference numeral 2 denotes a fore edge portion on an opposite side of the spine portion 4, reference numeral 3*a* denotes a front surface of the booklet S, and reference numeral 3*b* denotes a back surface of the booklet S, respectively. Here, the "front surface" and the "back surface" are discriminated for the sake of expedience. In FIG. 1 and FIG. 2, reference numeral A indicates a depth direction of the booklet S from the fore edge portion 2 to the spine portion 4, reference numeral B indicates a height direction of the booklet S in which the spine portion 4 extends, and reference numeral C indicates a thickness direction of the booklet S from the front surface 3*a* to the back surface 3*b*.

Figure 3:
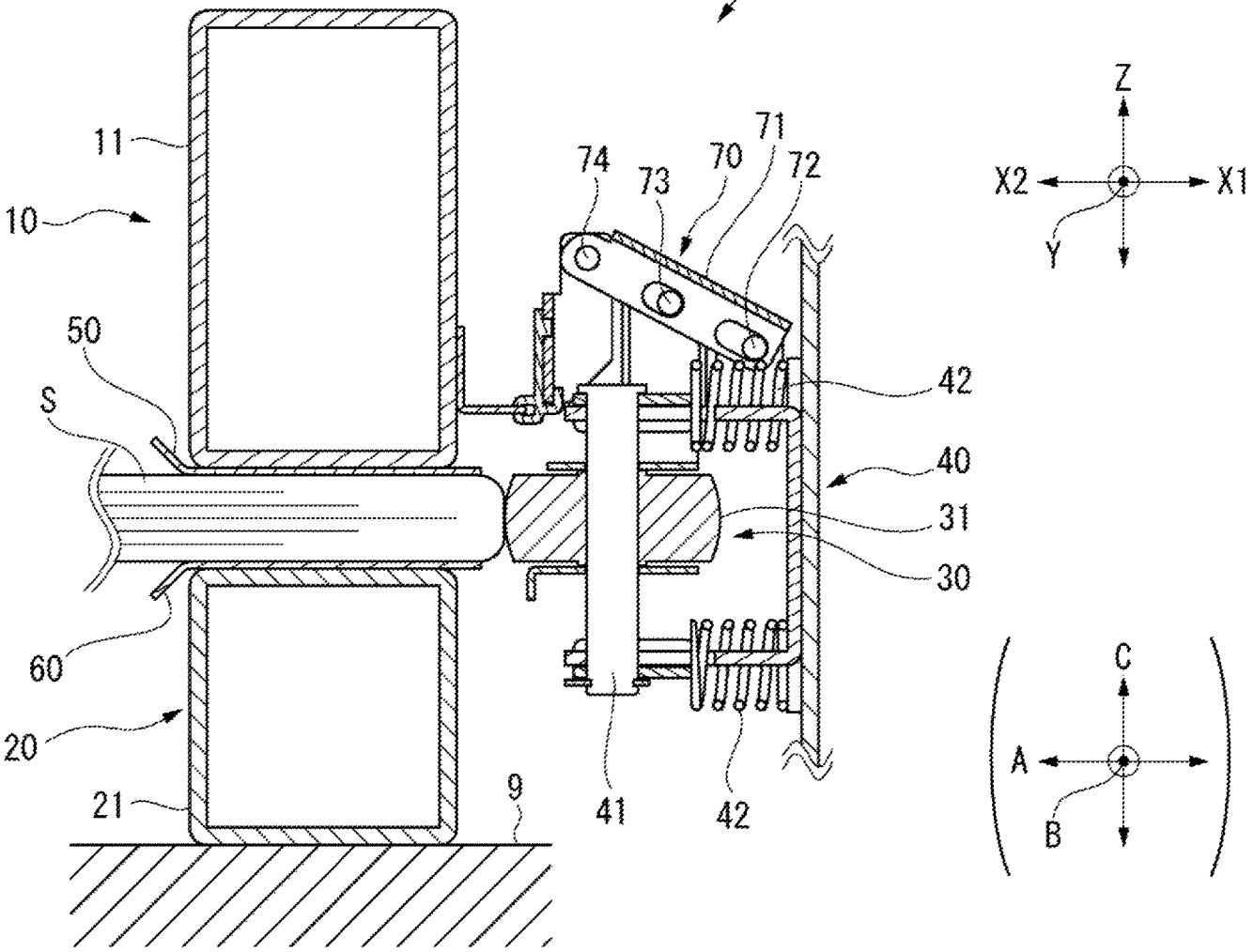
FIG. 3 is a side sectional view showing the booklet finishing device according to the present embodiment.

FIG. 3 is a side sectional view showing a booklet finishing device 1 according to the present embodiment. The booklet finishing device 1 presses the spine portion 4 of the booklet S toward the fore edge portion 2 in the depth direction A perpendicular to the thickness direction C of the booklet S. Thus, the spine portion 4 is flattened, and corner portions are formed at a boundary between the spine portion 4 and the front surface 3*a* and at a boundary between the spine portion 4 and the back surface 3*b*. A state in which the spine portion 4 is flattened and the corner portions are formed at the boundary between the spine portion 4 and the front surface 3*a* and at the boundary between the spine portion 4 and the back surface 3*b* is called a finished state of the booklet S.

As shown in FIG. 3, the booklet finishing device 1 includes a frame 9, a first pressing unit 10, a second pressing unit 20, a forming roller 30, and a forming roller moving unit 40.

In the following description, in FIG. 3, a direction from the left to the right is referred to as an insertion direction X1, a direction from the right to the left is referred to as a forming roller pressing direction X2, a direction perpendicular to a paper surface of FIG. 3 is referred to as a forming roller moving direction Y, and an up-down direction is referred to as a pressing direction Z. The booklet S to be conveyed to the booklet finishing device 1 is set in an attitude in which the depth direction A is parallel to the insertion direction X1 and the forming roller pressing direction X2, the height direction B is parallel to the forming roller moving direction Y, and the thickness direction C is parallel to the pressing direction Z.

The booklet S of the first pressing unit 10 is supported by the frame 9 at both outer sides in the height direction B of the booklet S, and the first pressing unit 10 is configured to move in the pressing direction Z. The second pressing unit 20 is fixed to the frame 9. The first pressing unit 10 and the second pressing unit 20 move relative to each other in the thickness direction C of the booklet S. Although in the present embodiment the first pressing unit 10 is configured to press the front surface 3*a* of the booklet S and the second pressing unit 20 is configured to press the back surface 3*b* of the booklet S, the first pressing unit 10 may be configured to press the back surface 3*b* of the booklet S and the second pressing unit 20 may be configured to press the front surface 3*a* of the booklet S.

The forming roller moving unit 40 supports the forming roller 30 around a rotation axis extending in the pressing direction Z through the rotation shaft portion 41. The forming roller moving unit 40 is configured to press the forming roller 30 in the roller pressing direction X2 perpendicular to the thickness direction of the booklet S (the pressing direction Z) by an energization unit 42 such as a spring. The energization unit 42 is preferably provided at both ends of the rotation shaft portion 41. The forming roller moving unit 40 moves the forming roller 30 along the spine portion 4 while pressing the forming roller 30 perpendicularly to the spine portion 4 of the booklet S. The forming roller moving unit 40 linearly moves the forming roller 30 in the forming roller moving direction Y.

The forming roller 30 includes a barrel-shaped roller surface 31, with a center portion in the width direction (pressing direction Z) thereof protruding. The roller surface 31 is in surface contact with the spine portion 4 of the booklet S when the forming roller 30 is pressed in the forming roller pressing direction X2 (perpendicular to the thickness direction). The forming roller moving unit 40 supports the forming roller 30 in a manner that a center of the forming roller 30 in the width direction coincides with a center of the booklet S in the thickness direction C.

Figure 4:
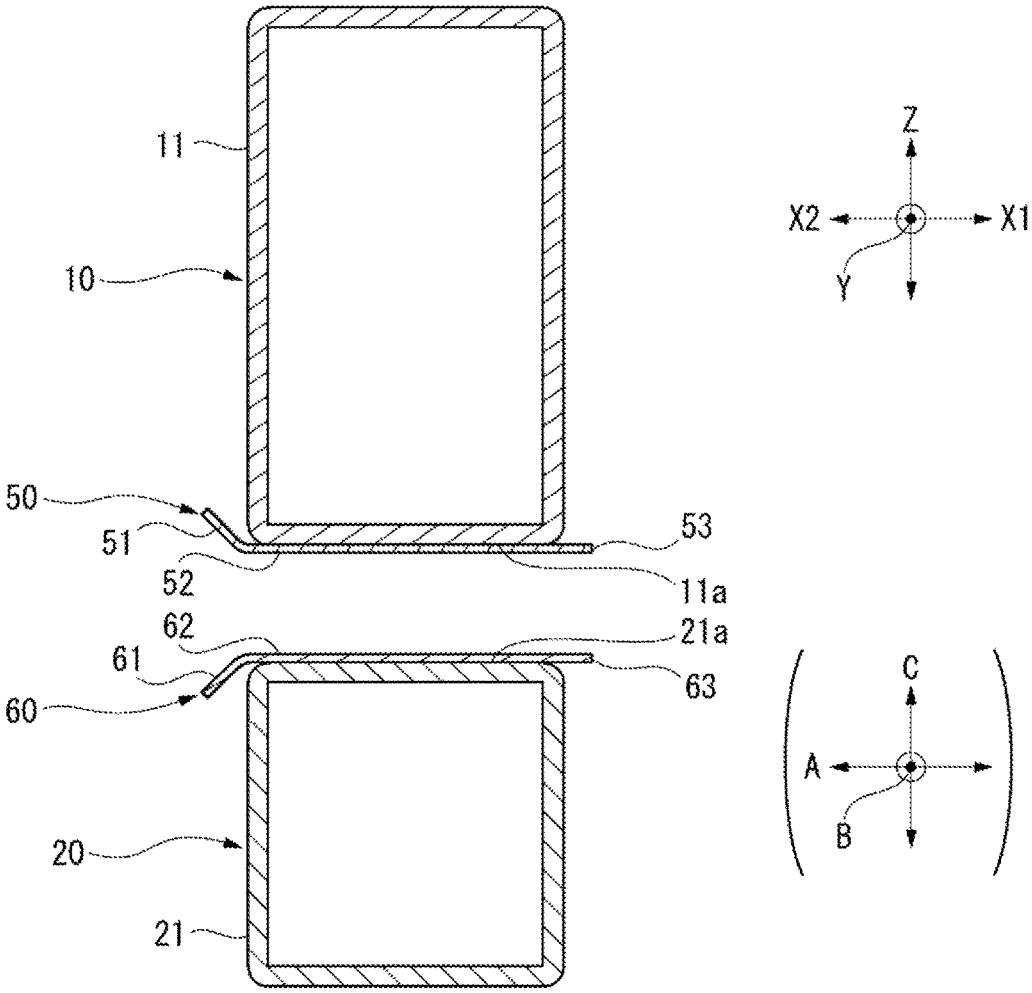
FIG. 4 is an enlarged view of a first pressing unit and a second pressing unit.

FIG. 4 is an enlarged view of the first pressing unit 10 and the second pressing unit 20. As shown in FIG. 4, the first pressing unit 10 includes a first movable component 11 and a first guide component 50. The first movable component 11 is a rectangular tubular member. The first movable component 11 is a long member extending in the forming roller moving direction Y. The first movable component 11 is supported by the frame 9 at both outer sides in the height direction B of the booklet S, and the first movable component 11 is configured to move by a driving mechanism (not shown) in the pressing direction Z (the thickness direction C of the booklet S).

The first guide component 50 is a plate-shaped component formed of a member different from the first movable component 11. Here, a plate shape means a shape including a flat plate shape, a bent plate shape, and a curved plate shape.

The first guide component 50 is attached to a lower surface 11*a* (a surface facing the second pressing unit 20) of the first movable component 11. A first guide surface 51, a first contact surface 52, and a first corner-forming end portion 53 are provided on the lower surface (the surface facing the second pressing unit 20) of the first guide component 50. A dimension of the first guide component 50 in the forming roller moving direction Y is longer than a dimension of the booklet S to be finished in the height direction B (see FIG. 1).

The first contact surface 52 extends along the forming roller moving direction Y. The first contact surface 52 is a flat surface and configured to surface contact with the front surface 3*a* of the booklet S. The first contact surface 52 is brought into surface contact with at least a region of the front surface 3*a* of the booklet S that is close to the spine portion 4.

The first guide surface 51 is provided to the left of the first contact surface 52. The first guide surface 51 is provided closer to an insertion side of the booklet S (a side of the forming roller pressing direction X2) than the first contact surface 52. The first guide surface 51 is inclined such that an interval between the first guide surface 51 and the second pressing unit 20 is widened toward the insertion side of the booklet S (the side of the roller pressing direction X2). The first guide surface 51 is a surface smoothly continuous toward the first contact surface 52.

The first corner-forming end portion 53 is an end portion of the first guide component 50 at a side opposite to the insertion side of the booklet S (at the side of the forming roller pressing direction X2). The first corner-forming end portion 53 and the forming roller 30 form a corner portion between the spine portion 4 and the front surface 3*a* of the booklet S. The first corner-forming end portion 53 has a corner portion between a lower surface (the surface from the first contact surface 52 to the first corner-forming end portion 53) and the right surface (the surface on the side of the insertion direction X1 of the first corner-forming end portion 53) of the first guide component 50. The corner portion may come into contact with the front surface 3*a* or the spine portion 4 of the booklet S. It is preferable that rounding or chamfering (deburring) of the corner portion is minimized, and that the angle formed by the lower surface and the right surface of the first guide component 50 is substantially a right angle (about 90°).

Like the first pressing unit 10, the second pressing unit 20 includes a second movable component 21 and a second guide component 60. The second movable component 21 is a rectangular tubular member. The second movable component 21 is a long member extending in the forming roller moving direction Y. The second movable component 21 is fixed to the frame 9 (see FIG. 3). The first movable component 11 and the second movable component 21 are configured to move relative to each other in the pressing direction Z. In the examples shown in FIG. 3 and FIG. 4, the first movable component 11 is configured to move by a driving mechanism (not shown) in the pressing direction Z with respect to the second movable component 21 fixed to the frame 9.

Like the first guide component 50, the second guide component 60 is a plate-shaped component formed of a member different from the second movable component 21. Here, examples of a plate shape also include a flat plate shape, a bent plate shape, and a curved plate shape.

The second guide component 60 is attached to an upper surface 21*a* (a surface facing the first pressing unit 10) of the second movable component 21. A second guide surface 61, a second contact surface 62, and a second corner-forming end portion 63 are provided on the upper surface (the surface facing the first pressing unit 10) of the second guide component 60. Like the first guide component 50, a dimension of the second guide component 60 in the forming roller moving direction Y is longer than the dimension of the booklet S to be finished in the height direction B (see FIG. 1).

The second contact surface 62 extends along the forming roller moving direction Y. The second contact surface 62 is a flat surface and configured to surface contact with the back surface 3*b* of the booklet S. The second contact surface 62 is brought into surface contact with at least a region of the back surface 3*b* of the booklet S that is close to the spine portion 4. The second contact surface 62 is provided to face the first contact surface 52. The second contact surface 62 is provided parallel to the first contact surface 52.

The second guide surface 61 is provided to the left of the second contact surface 62. The second guide surface 61 is provided closer to the insertion side of the booklet S (the side of the forming roller pressing direction X2) than the second contact surface 62. The second guide surface 61 is inclined in a manner that an interval between the second guide surface 61 and the first pressing unit 10 is widened toward the insertion side of the booklet S (the side of the roller pressing direction X2). The second guide surface 61 is smoothly continuous toward the second contact surface 62.

The second corner-forming end portion 63 is an end portion on the side opposite to the insertion side (a side of the forming roller pressing direction X2) of the booklet S. The second corner-forming end portion 63 and the forming roller 30 form a corner portion between the spine portion 4 and the back surface 3*b* of the booklet S. The second corner-forming end portion 63 is provided at a position facing the first corner-forming end portion 53. The second corner-forming end portion 63 has a corner portion between an upper surface (the surface from the second contact surface 62 to the second corner-forming end portion 63) and the right surface (the surface on the side of the insertion direction X1 of the second corner-forming end portion 63) of the second guide component 60. The corner portion may come into contact with the back surface 3*b* or the spine portion 4 of the booklet S. It is preferable that rounding or chamfering (deburring) of the corner portion is minimized, and that the angle formed by the upper surface and the right surface of the second guide component 60 is substantially a right angle.

In the booklet finishing device 1 described above, the booklet S is supplied to the booklet finishing device 1 in an attitude in which the height direction B of the booklet S is parallel to the forming roller moving direction Y of the booklet finishing device 1 and the thickness direction C of the booklet S is parallel to the pressing direction Z of the booklet finishing device 1. As shown in FIG. 3, the booklet S is inserted to a position where the spine portion 4 protrudes farther toward the insertion direction X1 from the first corner-forming end portion 53 and the second corner-forming end portion 63. Since the first guide surface 51 and the second guide surface 61 are provided in a manner that a distance between the first guide surface 51 and the second guide surface 61 are widened in the forming roller pressing direction X2, the booklet S is easily inserted between the first pressing unit 10 and the second pressing unit 20.

In a state where the booklet S is inserted to the position shown in FIG. 3, the first pressing unit 10 is moved in the pressing direction Z toward the side of the second pressing unit 20, and thereby the booklet S is firmly clamped between the first contact surface 52 and the second contact surface 62. In this state, the forming roller 30 is moved by the forming roller moving unit 40 in the forming roller moving direction Y. At this time, the forming roller 30 is energized in the forming roller pressing direction X2 by the energization unit 42, and thus the forming roller 30 is moved from one end to the other end of the spine portion 4 of the booklet S while being pressed against the spine portion 4.

Then, since the forming roller 30 pushes the spine portion 4 of the booklet S toward a side of the fore edge portion 2, the spine portion 4 of the booklet S is flattened. Since the spine portion 4 of the booklet S is flattened by the forming roller 30, like the booklet S shown in FIG. 2, a booklet S can be obtained with the corner portion 5*a* between the front surface 3*a* and the spine portion 4 and the corner portion 5*b* between the back surface 3*b* and the spine portion 4 neatly finished. Further, the corner portion 5*a* between the front surface 3*a* and the spine portion 4 of the booklet S is formed as a substantially right angle by the forming roller 30 and the first corner-forming end portion 53, and the corner portion 5*b* between the back surface 3*b* and the spine portion 4 of the booklet S is formed as a substantially right angle by the forming roller 30 and the second corner-forming end portion 63. Thus, a more neatly-finished booklet S can be obtained.

According to the booklet finishing device 1 of the present embodiment, the booklet S is easily guided to the space between the first pressing unit 10 and the second pressing unit 20 by the first guide surface 51. Not only the spine portion 4 of the booklet S can be formed flat by the forming roller 30, but also the corner portion 5*a* between the spine portion 4 and the front surface 3*a* of the booklet S can be more neatly finished by the forming roller 30 and the first corner-forming end portion 53.

The first guide component 50 is a component different from the first movable component 11. Therefore, the first guide component 50 can be formed using, for example, a metal plate. In this case, the first guide surface 51 continuous from the first contact surface 52 can be formed by simple bending of the metal plate. The first corner-forming end portion 53 continuous from the first contact surface 52 can be formed by a simple cutting process of the metal plate and a simple deburring process (grinding or polishing) performed as necessary. Therefore, the first guide component 50 can be easily formed with high accuracy by simple bending and cutting of the metal plate and deburring (grinding or polishing) performed as necessary.

Alternatively, since the first guide component 50 is a component different from the first movable component 11, the first guide component 50 can be formed using, for example, a resin plate. In this case, the first guide surface 51 and the first corner-forming end portion 53 which are continuous from the first contact surface 52 can easily form the first guide component 50 with high accuracy through a resin molding method using a general mold.

The first guide component 50 may be configured by a single component or a combination of a plurality of components. When the first guide component 50 is processed from a single metal plate, or formed through a resin molding method as described above, the first guide component 50 can be easily formed with high accuracy.

In the booklet finishing device 1 according to the present embodiment, the second pressing unit 20 also includes the second guide component 60. Therefore, the booklet S can be reliably guided and positioned between the first pressing unit 10 and the second pressing unit 20 by the first guide surface 51 and the second guide surface 61. Further, since both of the corner portion 5*a* between the spine portion 4 and the front surface 3*a* and the corner portion 5*b* between the spine portion 4 and the back surface 3*b* of the booklet S can be formed in a nice shape by the first corner-forming end portion 53 and the second corner-forming end portion 63, the booklet S can be more neatly finished.

As shown in FIG. 3, the booklet finishing device 1 according to the present embodiment includes an aligning mechanism 70. The aligning mechanism 70 is a mechanism for moving the forming roller 30 along the pressing direction Z. When the first pressing unit 10 contacts the front surface 3*a* of the booklet S, the second pressing unit 20 contacts the back surface 3*b* of the booklet S and the booklet S is pressed in the pressing direction Z, the aligning mechanism 70 moves the forming roller 30 in accordance with the clearance distance (interval) between the first contact surface 52 and the second contact surface 62 in the pressing direction Z. The forming roller 30 is moved by the aligning mechanism 70 in the thickness direction C of the booklet S such that the center of the roller surface 31 in the width direction is positioned at a center of the thickness of the booklet S.

The aligning mechanism 70 shown in FIG. 3 includes a first shaft 74 provided on the first pressing unit 10, a second shaft 73 provided on the forming roller 30, a third shaft 72 provided on the second pressing unit 20 or the frame 9, and a lever component 71. The lever component 71 includes a first hole portion through which the first shaft 74 passes, a second hole portion through which the second shaft 73 passes, and a third hole portion through which the third shaft 72 passes. Centers of the first hole portion, the second hole portion, and the third hole portion are preferably located in the same straight line.

Figure 5:
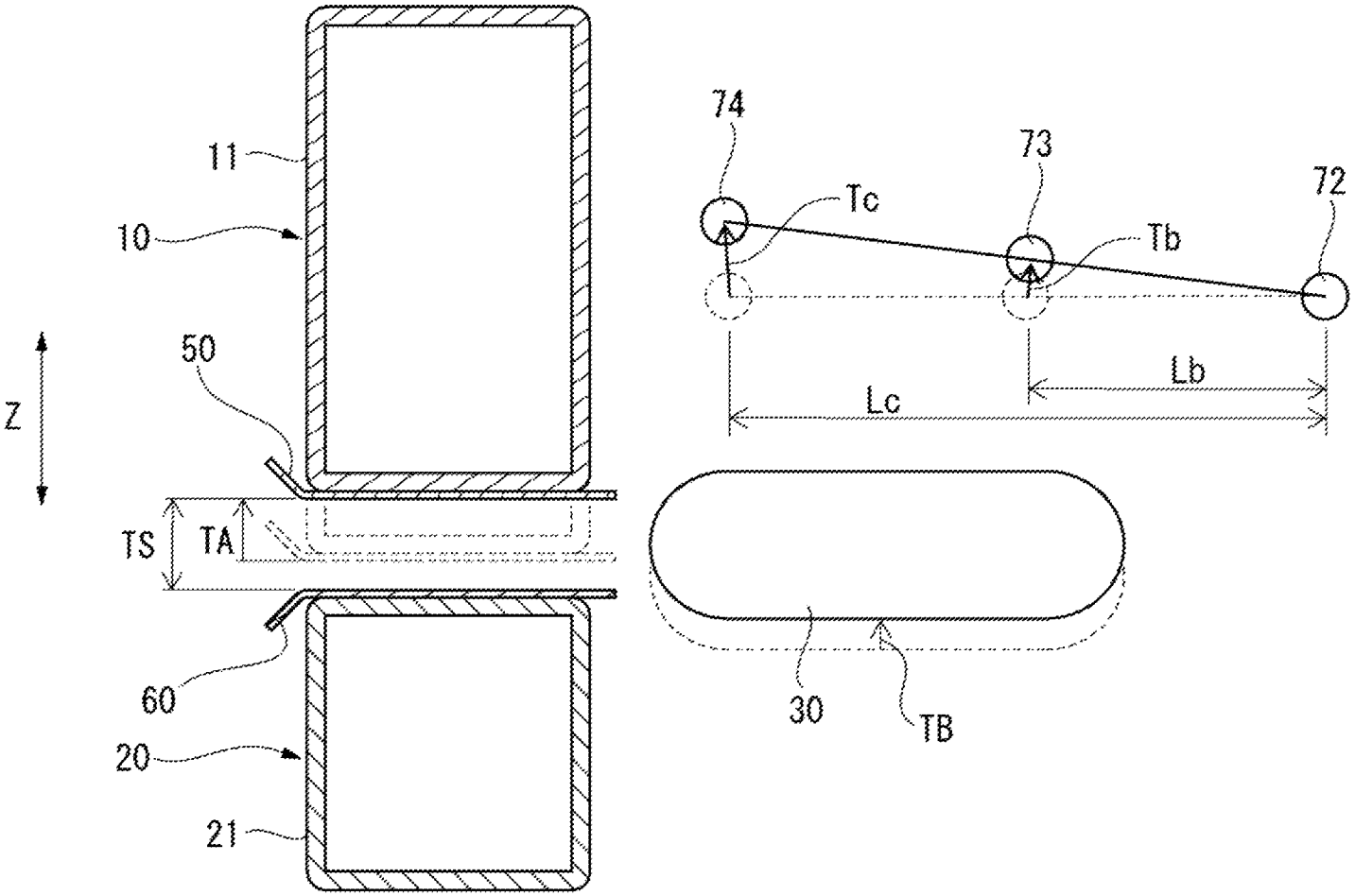
FIG. 5 is a diagram schematically showing an aligning mechanism of the booklet finishing device.

FIG. 5 is a diagram schematically showing modeling of the aligning mechanism 70 shown in FIG. 3. As shown in FIG. 5, the aligning mechanism 70 configures a lever mechanism in which the first shaft 74 serves as a force point, the second shaft 73 serves as a point of application, and the third shaft 72 serves as a fulcrum. In the lever mechanism shown in FIG. 5, it is preferable that a length Lc from the force point (the first shaft 74) to the fulcrum (the third shaft 72) and a length Lb from the point of application (the second shaft 73) to the fulcrum (the third shaft 72) satisfy the relationship $Lc=2\times Lb$. In the aligning mechanism 70 shown in FIG. 3, the third shaft 72 serving as a fulcrum can move in the third hole portion (a long hole) provided on the lever component 71, but it is assumed that the third shaft 72 serving as the fulcrum does not move in the aligning mechanism 70 shown in FIG. 5, and the viewpoint is changed to perform modeling.

According to this configuration, when the first pressing unit 10 moves by a moving amount TA in the pressing direction Z according to the thickness of the booklet S, the first shaft 74 serving as the force point moves upward in the pressing direction Z (upward in FIG. 5) by a moving amount Tc, the second shaft 73 serving as the point of application moves upward (upward in FIG. 5) by a moving amount Tb in the pressing direction Z by moving in a manner of being slightly inclined toward the pressing direction X1 in the second hole portion which is a long hole, and the third shaft 72 serving as the fulcrum is stationary.

At this time, based on the relationship $Lc=2\times Lb$ described above, the moving amount Tc of the first shaft 74 and the moving amount Tb of the second shaft 73 substantially satisfy the relationship $Tc=2\times Tb$. Thus, the forming roller 30 moves in the pressing direction Z by a moving amount TB which is half of the thickness TS of the booklet S, and the center of the roller surface 31 of the forming roller 30 is positioned substantially at the center of the thickness of the spine portion 4 of the booklet S. Therefore, when the spine portion 4 of the booklet S is flattened, the first pressing unit 10 and the second pressing unit 20 press the booklet S appropriately, and simultaneously, the forming roller 30 is moved to the center position (TS/2) of the thickness TS of the spine portion 4. Therefore, the shaping roller 30 can press the center portion in the thickness direction of the spine portion 4 of the booklet S to a direction perpendicular to the spine portion (pressing direction Z), and the flattening can be performed even more neatly.

According to the configuration satisfying the relationship $Lc=2\times Lb$ described above, the spine portion 4 of the booklet S can be flattened more neatly. From the viewpoint of achieving such an effect, the forming roller 30 is allowed to have a positioning error of about 30%. When the thickness of the booklet S is, for example, 10 mm, the center of the forming roller 30 can be moved to a position 5 mm (=10 mm/2) from the front surface 3*a* of the booklet S by the above-described lever mechanism. In this relationship, the positioning of the forming roller 30 with respect to the center of the thickness of the booklet S at which the forming roller 30 is positioned (the position of 5 mm described above) can allow an error of about 30% as described above, that is, an error of about 5 mm±1.5 mm (=5 mm×30%) as described above. From this viewpoint, the length Lc and the length Lb may be configured to satisfy the relationship Lc=1.4×Lb to 2.6×Lb.

In the embodiment described above, the configuration example in which the first pressing unit 10 is configured to move in the pressing direction Z with respect to the frame 9 and the second pressing unit 20 is fixed to the frame 9 has been described, but the present invention is not limited thereto. For example, the first pressing unit 10 may be fixed to the frame 9 and the second pressing unit 20 may be configured to move in the pressing direction Z with respect to the first pressing unit 10. The first pressing unit 10 and the second pressing unit 20 may both be supported by the frame 9 in a movable manner.

In the embodiment described above, the configuration example in which the second pressing unit 20 includes the second movable component 21 and the second guide component 60 has been described, but the present invention is not limited thereto. The second pressing unit 20 may not include the second guide component 60. When a guide component for guiding, for example, the lower surface of the booklet S to the surface of the second pressing unit 20 configured to contact the back surface 3*b* of the booklet S is provided in the device for supplying the booklet S to the booklet finishing device 1, the first guide component 50 may be provided only on the first pressing unit 10.

The front surface 3*a* of the booklet S does not necessarily refer to the cover of the booklet. The front surface 3*a* and the back surface 3*b* of the booklet S are formed of the sheet surface of the sheet material configuring the booklet S, and are used only for the sake of convenience to express the fact that the first pressing unit 10 and the second pressing unit 20 can press two surfaces in parallel with each other when the booklet S is being pressed. Therefore, the first pressing unit 10 may press the front cover or the back cover of the booklet S.

What is claimed is:

1. A booklet finishing device for flattening a spine portion of a booklet formed by folding a plurality of sheet materials, the booklet finishing device comprising:

a frame;

a first pressing unit and a second pressing unit which are configured to move relative to each other in a thickness direction of the booklet and configured to press a front surface and a back surface of the booklet respectively;

a forming roller configured to press the spine portion in a direction perpendicular to the thickness direction; and a forming roller moving unit that moves the forming roller along the spine portion, wherein the first pressing unit includes:

a first movable component supported by the frame and configured to move relative to the second pressing unit in the thickness direction; and a first guide component having a bent plate shape and attached to a surface of the first movable component facing the second pressing unit, wherein a surface of the first guide component facing the second pressing unit includes:

a first guide surface inclined to an insertion side of the booklet in a manner that the interval between the first guide surface and the second pressing unit is widened toward the insertion side of the booklet;

a first contact surface extending along the moving direction of the forming roller and configured to contact the front surface of the booklet; and a first corner-forming end portion configured to form a corner portion of the spine portion of the booklet with the forming roller, the first corner-forming end portion being opposite to the insertion side of the booklet, wherein the first guide component bends between the first guide surface and the first contact surface, and wherein the roller surface of the forming roller has a barrel-shape in which a center portion in a width direction of the roller surface protrudes.

2. The booklet finishing device according to claim 1, wherein the second pressing unit comprises:

a second movable component supported by the frame and configured to move relative to the first pressing unit in the thickness direction of the booklet; and a second guide component having a bent plate shape and attached to a surface of the second movable component facing the first pressing unit, wherein a surface of the second guide component facing the first pressing unit includes:

a second guide surface inclined to the insertion side of the booklet in a manner that an interval between the second guide surface and the first pressing unit is widened toward the insertion side of the booklet;

a second contact surface extending along the moving direction of the forming roller and configured to contact the back surface of the booklet; and a second corner-forming end portion configured to form a corner portion of the spine portion of the booklet with the forming roller, the second corner-forming end portion being opposite to the insertion side of the booklet, wherein the second guide component bends between the second guide surface and the second contact surface.

3. The booklet finishing device according to claim 2, further comprising:

an aligning mechanism that moves a center in the width direction of the roller surface of the forming roller to a center in the thickness direction of the booklet according to a clearance distance between the first contact surface and the second contact surface when the first pressing unit and the second pressing unit press the booklet.

4. The booklet finishing device according to claim 3, wherein the second pressing unit is fixed to the frame;

the aligning mechanism includes:

a first shaft provided on the first pressing unit;

a second shaft provided on the forming roller;

a third shaft provided on the second pressing unit or the frame; and a lever component including:

a first hole portion through which the first shaft passes;

a second hole portion through which the second shaft passes; and a third hole portion through which the third shaft passes, wherein the first shaft serves as a force point, the second shaft serves as a point of application, and the third shaft serves as a fulcrum.

* * * * *